US005803320A

United States Patent [19]

Cutting et al.

[11] Patent Number: 5,803,320

[45] Date of Patent: Sep. 8, 1998

[54] CARBONATED COFFEE BEVERAGE DISPENSER

[75] Inventors: Robert A. Cutting, Kent; Gregory R. Gemmell, Akron; Thomas S. Green, Atwater, all of Ohio

[73] Assignee: ABC Dispensing Technologies, Akron, Ohio

[21] Appl. No.: 905,013

[22] Filed: Aug. 11, 1997

Related U.S. Application Data

[63] Continuation of Ser. No. 768,195, Dec. 17, 1996, abandoned, which is a continuation of Ser. No. 409,833, Mar. 27, 1995, abandoned.

[51] Int. Cl.[6] ..... B67D 5/56

[52] U.S. Cl. ..... 222/641; 222/129.1

[58] Field of Search ..... 222/129.1, 129.2, 222/129.3, 129.4, 641

[56] References Cited

U.S. PATENT DOCUMENTS

| | | | |
|---|---|---|---|
| 2,949,993 | 8/1960 | Adler | 222/129.4 X |
| 4,753,370 | 6/1988 | Rudick | 222/129.1 X |
| 4,821,925 | 4/1989 | Wiley et al. | 222/129.4 |
| 5,139,127 | 8/1992 | Ficken et al. | 222/129.1 X |
| 5,299,715 | 4/1994 | Feldman | 222/129.1 |
| 5,303,846 | 4/1994 | Shannon | 222/129.4 X |

*Primary Examiner*—Joseph Kaufman

*Attorney, Agent, or Firm*—Renner, Kenner, Greive, Bobak, Taylor & Weber

[57] ABSTRACT

The invention relates to an apparatus for dispensing cold, carbonated coffee beverages. The apparatus comprises a plurality of reservoirs for holding the beverage ingredients. Each reservoir is selectively connected to at least one dispensing pump that is controlled by a control unit. The pumps deliver the ingredients to a dispensing head that is configured to mix the ingredients external to the dispensing head. The basic ingredients are coffee extract, soda, and a sweetener. Additionally, ingredients such as decaffeinated coffee extract and water may be included to expand the range of beverage selections. The apparatus dispenses the ingredients in a manner that forms a desired creme on top of the beverage.

14 Claims, 2 Drawing Sheets

CARBONATED COFFEE BEVERAGE DISPENSER

This is a continuaton of application Ser. No. 08/768,195, filed Dec. 17, 1996, now abandoned, which is a continuation of application Ser. No. 08/409,833, filed Mar. 27, 1995 now abandoned.

TECHNICAL FIELD

The invention herein resides in the art of beverage dispensers. Specifically, the invention presents a beverage dispenser capable of repeatedly generating cold, carbonated coffee beverages.

BACKGROUND ART

Cold, carbonated coffee beverages are becoming increasingly popular throughout the United States. A cold, carbonated coffee beverage is generally a combination of coffee extract, sweetener, and soda. A properly made beverage is complete when the finished product has a foamy head on top of the liquid. The foamy head is commonly known as the "creme." Proper creation of the creme is one of the most important factors in creating a cold, carbonated, coffee beverage.

Consumers desire the carbonated coffee beverages in various sizes and strengths. Additionally, some consumers prefer decaffeinated to caffeinated beverages. The strength of the beverage is generally controlled by the amount of coffee extract in the beverage. For instance, a strong beverage has a higher percentage of coffee extract than a regular beverage. A light beverage not only has a reduced percentage of coffee extract than a regular beverage, but may also have a reduced concentration of soda. This is often achieved by adding regular water to the soda to deceive the effect of the soda on the beverage's taste and feel. The creme on top of the liquid is a foamy substance generally comprising extract oils and soda bubbles. The amount of coffee extract in the beverage, the amount of agitation, and the rate at which the coffee extract is added are major contributors to the consistency of the creme.

Currently, cold, carbonated coffee beverages are created and mixed by hand. The person who produces the beverage must measure the individual ingredients for each drink's size and strength. The most difficult aspect of hand-mixing these beverages is the formation of the creme. Producing the beverage by hand is also labor intensive and results in inconsistent composition and creme quality.

Known beverage dispensing systems are not suitable for creating cold, carbonated coffee beverages. These systems do not properly form the creme and do not provide the ability to produce all of the desired combinations of the cold, carbonated coffee beverages. There is a need in the art for a beverage dispenser that can repeatedly and reliably generate cold, carbonated coffee beverages. There is clearly a need in the art for a system that reduces costs, increases accuracy and reliability, assures complete mixing, ensures proper creme formation, and accommodates faster generation times.

DISCLOSURE OF THE INVENTION

In light of the foregoing, it is a first aspect of the invention to provide a beverage dispenser that repeatedly generates cold, carbonated coffee beverages.

Another aspect of the invention is the provision of a beverage dispenser that is capable of generating at least three sizes of cold, carbonated coffee beverages.

Still a further aspect of the invention is the provision of a beverage dispenser that is capable of generating at least three strengths of cold, carbonated coffee beverages.

Yet another aspect of the invention is the provision of a beverage dispenser that is capable of generating caffeinated and decaffeinated cold, carbonated coffee beverages.

Still a further aspect of the invention is the provision of a beverage dispenser that creates creme on top of any of the desired combinations of cold, carbonated coffee beverage choices available.

An additional aspect of the invention is the provision of a beverage dispenser that reduces the concentration of soda when a light strength is desired.

The foregoing and other aspects of the invention which will become apparent as the detailed description proceeds are achieved by a carbonated coffee dispenser, comprising: supply means for storing a plurality of ingredients; a dispensing head in selective fluid communication with said supply means; pump means for selectively delivering said plurality of ingredients to said dispensing head; and control means for selectively activating said pump means.

Still other aspects of the invention which will become apparent herein are attained by a carbonated coffee dispensing assembly, comprising: at least three supply reservoirs; a dispensing head in selective fluid communication with each of said supply reservoirs; at least one pump operatively connected to each of said supply reservoirs; at least one valve operatively disposed between each of said pumps and said dispensing head; and control means for regulating each of said pumps and each of said valves.

DESCRIPTION OF DRAWINGS

For a complete understanding of the objects, techniques, and structure of the invention reference should be made to the following detailed description and accompanying drawings, wherein.

BEST MODE FOR CARRYING OUT THE INVENTION

Figure 1:
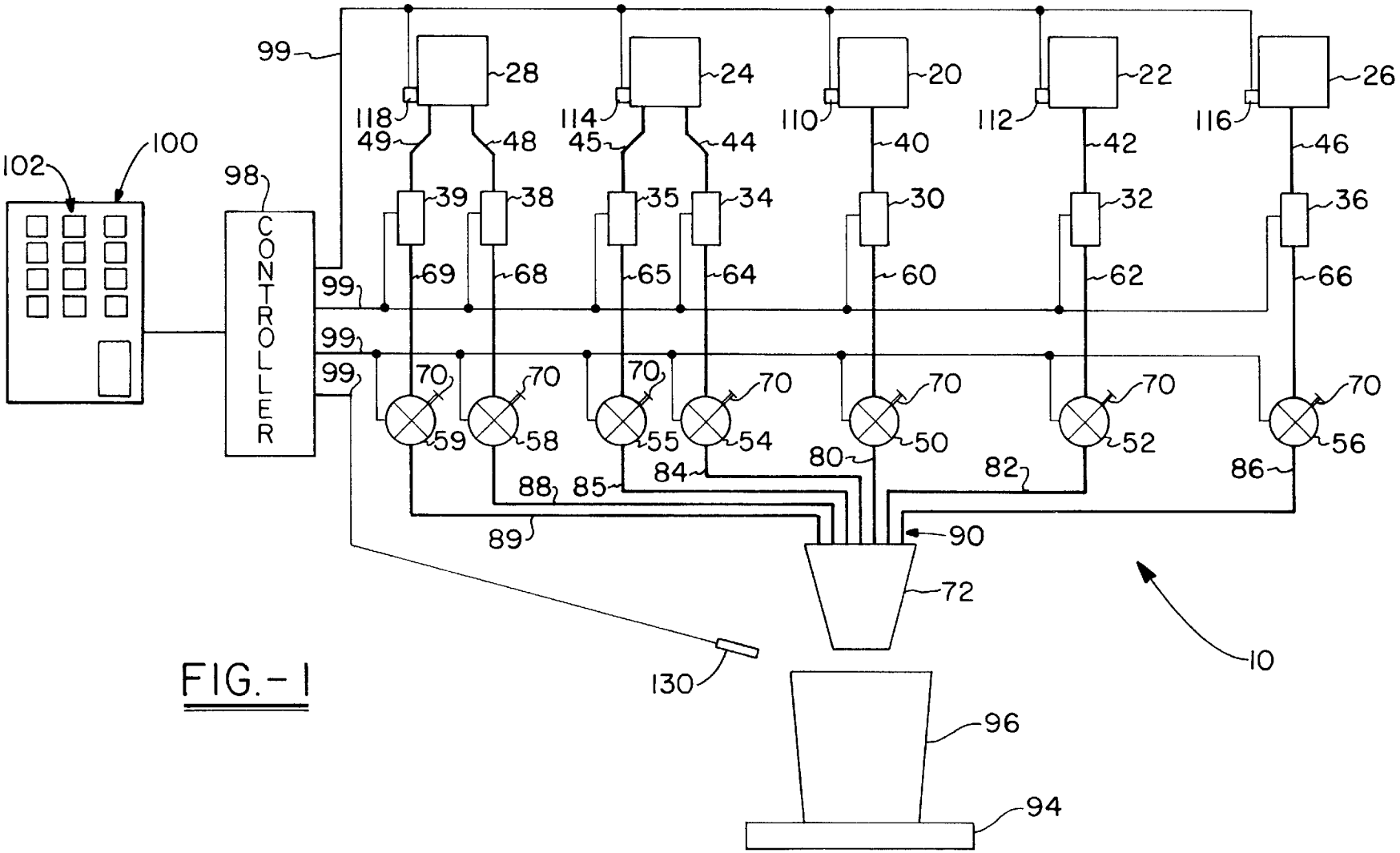
FIG. 1 is a schematic diagram of a cold, carbonated coffee beverage dispensing system according to the present invention.

Referring now to FIG. 1, it can be seen that the cold, carbonated coffee beverage dispenser according to the present invention is designated generally by the numeral 10. The beverage dispenser 10 requires supply reservoirs for at least three ingredients: a soda reservoir 20, a sweetener reservoir 22, and a coffee extract reservoir 24. In order to provide a wider range of beverage choices, a water reservoir or supply 26 and a decaffeinated coffee extract reservoir 28 are provided. Each supply reservoir 20–28 may be of a type that is well known in this art.

Each supply reservoir 20–28 is operatively connected to at least one dispensing pump 30–39 by a fluid delivery line 40–49. Each coffee extract supply reservoir 24 and 28 is connected to a pair of dispensing pumps. The regular coffee extract reservoir 24 is operatively connected to two dispensing pumps 34 and 35 by individual fluid delivery lines 44 and 45. Similarly, the decaffeinated coffee extract reservoir 28 is operatively connected to two dispensing pumps 38 and 39 by individual fluid delivery lines 48 and 49. The dispensing pumps 30–39 are generally well known in the art of beverage dispensing. The output of each pump 30–39 is operatively connected to a dispensing valve 50–59 by a fluid delivery line 60–69. Each fill valve 50–59 is capable of being electronically opened and closed and may be an electrical solenoid valve for the purpose of the present invention. Each fill valve 50–59 has a manually operated flow rate adjustment mechanism 70, such as a screw, that may be adjusted to control the flow rate through the dispensing valve 50–59. By adjusting the flow rate adjustment mechanism 70, the flow rate through a dispensing valve 50–59 can be set independently of the flow rate capability of the dispensing pumps 30–39. As will later be described, the flow rate of each beverage ingredient is an important aspect in the production of the creme. Each coffee extract supply reservoir 24 and 28 is attached to two dispensing pumps so that a large quantity of coffee extract can be obtained in a short period of time. As will be discussed in more detail later, a large volume of coffee extract is required to form "stout" drinks.

Figure 2:
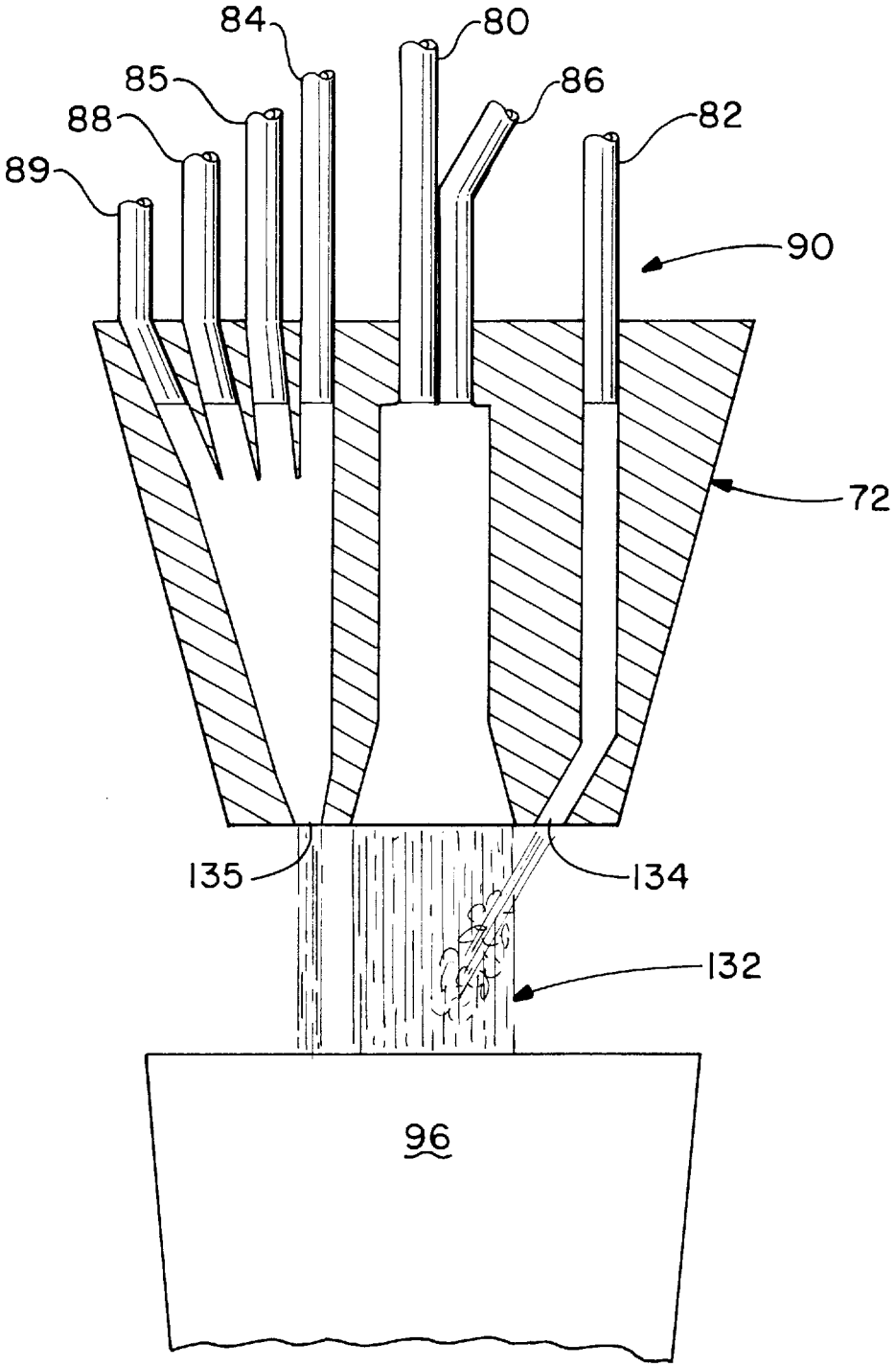
FIG. 2 is a illustrative cross-sectional view of the dispensing head as used in conjunction with the present invention.

As best shown in FIG. 2, the output of each fill valve 50–59 is operatively connected to an input section of a dispensing head 72 by a fluid delivery line 80–89. The dispensing head 72 is well known in the art. The dispensing head 72 has a plurality of input sections 90. The fluid delivery lines 80–89 are operatively connected to a corresponding input section 90 on the dispensing head 72. For instance, the soda delivery line 80 is operatively connected to the input section 90 on the dispensing head 72 that is designed to accept soda. The other delivery lines 82–89 are similarly connected. The dispensing head 72 is presented from a base, or cabinet (not shown), that may house the reservoirs 20–28, pumps 30–39, fill valves 50–59, and various delivery lines required to deliver the beverage ingredients to the dispensing head 72. The cabinet 92 has a shelf 94 for holding a container 96, such as a cup or glass, below the dispensing head 72. The shelf 94 is disposed far enough below the dispensing head 72 to accommodate at least three different sizes of containers 96. For the purpose of this description, the sizes will be referred to as small, medium, and large.

The cabinet (not shown) also houses a control unit 98 and a selection panel 100. The control unit 98 may be a dedicated microprocessor or an equivalent. As shown, the control unit 98 is interconnected with each of the dispensing pumps 30–39, each of the dispensing valves 50–59, and all other components by suitable communication lines 99. Additionally, the control unit 98 is connected to the selection panel 100. The selection panel 100 provides a plurality of switches, pads, or buttons 102 that provide the various alternative beverage choices to an operator. For instance, the selection panel 100 may have a button for caffeinated coffee extract and a button for decaffeinated coffee extract. Similarly, the selection panel may have various buttons for each different beverage size. Additionally, the selection panel 100 may have a plurality of buttons allowing the operator to regulate strength of the beverage.

The control unit 98 accepts and responds to inputs from the selection panel 100. The control unit 98 obtains information from the selection panel 100 and correspondingly manipulates the dispensing pumps 30–39 and the dispensing valves 50–59 to dispense the beverage ingredients. The control unit 98 delivers the beverage ingredients to the dispensing head by selectively activating the dispensing pumps 30–39 corresponding to the ingredients. While the dispensing pumps 30–39 are supplying fluid pressure to the dispensing valves 50–59, the control unit 98 selectively opens the dispensing valves 50–59 and closes them after predetermined times. The order and the length of time that each valve 50–59 is opened is the dispensing sequence. The amount of time each valve 50–59 remains open depends upon various factors, including the size of the desired beverage and the type of beverage requested. For instance, the soda fill valve 50 would have to remain open longer for a large beverage than a small beverage.

A typical beverage contains approximately 55–65 percent soda mixed with 12–25 percent sweetener and 10–25 percent coffee extract. This combination typically produces a beverage having a Brix level between 9 and 11. The exact composition, however, depends upon the desired beverage characteristics. In the preferred embodiment of the present invention three beverage strengths are provided for: "light," "regular," and "stout." When a light beverage is desired, the control unit 98 directs less coffee extract from the reservoir 24 and directs water from the water reservoir 26 into the dispensing head 72. The water is used to reduce the effect of the soda on the beverage by reducing the carbonation level of the soda.

The consistency of the creme chiefly depends on mixing the ingredients external to the dispensing head, the amount of extract being dispensed, and the relative dispensing times of the beverage ingredients. The present invention provides for eighteen combinations of cold, carbonated coffee beverages. To insure that a proper creme is formed on top of each beverage, different dispensing sequences are required for each combination. The dispensing sequences are individual to each combination. For instance, a large, stout, caffeinated beverage may require that the soda and the coffee extract be dispensed throughout the entire dispensing process. However, a large, light, caffeinated beverage may require that the coffee extract only be added towards the end of the sequence. These sequences are controlled by the control unit 98 to ensure that a creme is formed in each of the eighteen different beverage types.

As shown in FIG. 1, a level sensor 110–118 is operatively attached to each reservoir 20–28. Each level sensor 110–118 communicates with the control unit 98. The level sensor 110–118 are configured to indicate to the control unit 98 when the ingredient level in each reservoir 20–28 is low. The control unit 98 responds to a low level reading from a sensor 110–118 and indicates which ingredient is low on the selector panel 100 by an ingredient level indicator 130. The level sensor 110–118 are now well known to those skilled in the art, and comprise a switch which is "made" and "broken" by the ingredient within the reservoir 20–28 at a particular level. It will be appreciated that the level sensors 110–118 may be at various positions, and need not be horizontally aligned.

At the beginning of operation, each reservoir 20–28 is filled with its corresponding ingredient. An operator then selects desired beverage characteristics from the selector panel 100. The control unit 98 will not activate any component of the dispenser 10 until an appropriate combination of selections has been made. For the purposes of the following explanation only, it is assumed that an operator selects a caffeinated, regular-strength, medium coffee beverage from the selector panel 100. The operator's selections are read by the control unit 98 which recognizes that a proper combination has been chosen. The control unit 98 then checks to see if a cup 96 has been placed on the shelf 94 of the cabinet (not shown). The control unit 98 receives this information from a cup sensor 130.

If a cup 96 is not in place under the dispensing head 72, the control unit 98 issues a warning through the selector panel 100. If a cup 96 is in place, the control unit 98 activates the coffee extract pump 34, the soda pump 30, and the sweetener pump 32. Activation of these pumps 30–34 creates fluid pressure in the delivery lines 60–64. The control unit 98 then opens and closes the dispensing valves 50–54 according to the dispensing sequence for the beverage selected. When a dispensing valve 50–54 is opened the fluid runs through the valves 50–54 and into the dispensing head 72 at a characteristic rate set by the adjustment mechanism 70.

As perhaps best shown in FIG. 2, the dispensing head 72 connects with the fluid delivery lines 80–89 at the input section 90. The dispensing head 72 changes the pressurized flow of the soda in the soda delivery line 80 to a "soft" flow of soda 132. A "soft" flow is a non-pressurized, free-falling stream of liquid. The water delivery line 86 connects with the dispensing head 72 at essentially the same location as the soda delivery line 80. The dispensing head 72 directs the sweetener to a plurality of ejection tubes 134 that surround the soft flow of soda 132. The ejection tubes 134 are disposed at angles such that the centerline of each ejection tube 134 intersects the path of the soft soda flow 132 at a point below the dispensing head 72 but above the cup 96. The ejection tubes 134 are configured in this manner because sweetener and soda do not generally mix easily. The ejection tubes 134 are therefore configured to cause the sweetener and the soda to begin mixing while falling into the cup 96. This may be done because the sweetener does not greatly contribute to the foaming that creates the creme. The extract, however, readily mixes with soda and significantly causes foaming. The dispensing head 72, therefore, directs the extract to a plurality of ejection tubes 135 that also surround the soft flow of soda 132 but are configured to shoot the extract directly into the cup 96. As the extract combines with the mixture of soda and sweetener in the cup 96, foaming occurs and the creme is formed.

When the dispensing system 10 is activated, the pumps, 30–39 provide enough pressure to push the sweetener and the extract out of the ejection tubes 134 and 135. The sweetener has sufficient momentum to enter the soda flow 132 and mix with the soda. The extract has enough momentum to enter the cup 96 and cause foaming. Mixing the extract, soda, and sweetener in this manner contributes to the correct formation of the creme on each drink. In the art of dispensing soft drinks—that is, dispensing combinations of soda and syrup—this type of dispensing head has been found to have the desirable effect of reducing foaming during rapid dispensing. In the present invention, where foam or creme is desired, the dispensing head has been found to be useful for forming the required creme when dispensing soda, coffee extract, and sweetener. The dispensing sequence that controls when each ingredient is dispensed also contributes to the creme formation. After the dispensing sequence is finished, the control unit 98 closes all of the dispensing valves 50–54 and deactivates the pumps 30–34. A similar process is used to create the remaining beverage combinations, although different ingredients are employed and different dispensing sequences are used.

The controllability of the various pumps and dispensing valves by the control unit 98 allows for the achievement of a broad range of carbonated coffee beverages. When a "light" drink is ordered, the carbonation level of the soda may be reduced by timed actuation of the valve 56 to allow water to dilute the soda as desired. In like manner, a "stout" drink may require the simultaneous actuation of valves 54,55 or 58,59 to assure an appropriate amount of extract for caffeinated and decaffeinated beverages, respectively. Additionally, when desired, a "splash" or "float" of extract or sweetener may be placed upon a drink at the end of a dispensing cycle to give the drink a characteristic initial "stout" or "sweet" taste. Such a "splash" or "float" may be achieved by simply delaying the termination of dispensing of the extract or sweetener to be the last so terminated, or by reopening the extract or sweetener valve for a short period following termination of dispensing of all ingredients.

It is further contemplated that various flavorings may also be dispensed into the drink when desired to provide a flavored drink. Such flavorings, typically in extract form, may be dispensed using an identical structure to that of the coffee extract. The flavoring may be introduced continuously, intermittently, or as a splash or float. Similarly, it is contemplated that the system 10 may include a selector button 102 which effects a shortage of dispensed drink to accommodate manual addition of milk, creams, flavoring, or the like. Typically, the soda dispensing cycle would be shortened to allow for availability of a small volume in the cup or glass for such addition.

As presented above, water may be added to a "light" drink, but not to a "regular" or "stout" one. Such addition is simply for purposes of maintaining a consistent carbonation level in all drinks. In "stout" drinks, the amount of extract is high and a resultant high level of foaming occurs. The foaming is caused in part by escaping $CO_2$ and results in a lowering of the effective carbonation level. The same is generally true for a "regular" drink. In "light" drinks, where the amount of extract is lower, there is less foaming and, accordingly, less $CO_2$ escapes, leaving a higher effective carbonation level. That carbonation level is then brought into line with the level characteristic of a "regular" or "stout" drink by diluting the soda through the addition of water.

Thus it can be seen that the objects of the invention have been satisfied by the structure presented above. While in accordance with the patent statutes only the best mode and preferred embodiment of the invention has been presented and described in detail. It is to be understood that the invention is not limited thereto or thereby. Accordingly, for an appreciation of the true scope and breadth of the invention reference should be made to the following claims.

What is claimed is:

1. A cold, carbonated coffee beverage dispenser, comprising:

supply means for storing a plurality of ingredients;

said supply means comprises at least three supply reservoirs, one of said supply reservoirs holding coffee extract, another of said supply reservoirs holding soda, and the other of said supply reservoirs holding sweetener;

a dispensing head in selective fluid communication with said supply means, said dispensing head having a plurality of coffee ejection tubes for dispensing coffee extract directly into a cup, a fluid delivery line for dispensing a free-falling stream of soda, and a plurality of angularly directed sweetener ejection tubes for dispensing sweetener, wherein said coffee ejection tubes are spaced apart from said fluid delivery line and wherein said sweetener ejector tubes direct the sweetener into the free-falling stream of soda outside of the dispensing head and above the cup, causing the soda and the sweetener to mix while falling into the cup whereupon the soda-sweetener mixture combines with the coffee extract in the cup, the soda mixing with the coffee extract to form a creme foam;

pump means for selectively delivering said plurality of ingredients to said dispensing head; and control means for selectively activating said pump means such that the cold carbonated coffee beverage has the creme foam formed in the top portion of the cup.

2. A cold, carbonated coffee beverage dispenser as set forth in claim 1, wherein said supply means further comprises a supply reservoir for holding decaffeinated coffee extract and another supply reservoir for holding water.

3. A cold, carbonated coffee beverage dispenser as set forth in claim 1, wherein a dispensing valve is operatively disposed between said pump means and said dispensing head.

4. A cold, carbonated coffee beverage dispenser as set forth in claim 3, wherein said pump means comprises at least one pump operatively connected to said supply means for each of said ingredients, and the maximum flow rate through each of said fill valves is independently adjustable.

5. A cold, carbonated coffee beverage dispenser as set forth in claim 1 wherein said dispensing head is configured such that each of said ingredients mix external to said dispensing head.

6. A cold, carbonated coffee dispensing assembly, comprising:

at least three supply reservoirs;

one of said supply reservoirs holding coffee extract, another of said supply reservoirs holding sweetener, and another of said supply reservoirs holding soda;

at least one pump operatively connected to each of said supply reservoirs;

a dispensing head having a plurality of extract ejection tubes, a fluid delivery line and a plurality of angular sweetener ejection tubes, said plurality of extract ejection tubes and said plurality of sweetener ejection tubes in fluid communication with their respective supply reservoirs and configured to at least maintain a fluid pressure flow generated by said at least one pump associated with their respective supply reservoirs, said fluid delivery line in fluid communication with said soda supply reservoir and configured to provide a comparatively reduced fluid pressure flow of said soda, wherein said angular sweetener ejector tubes direct the sweetener into the soda outside said dispensing head and above a cup, and wherein said extract ejection tubes direct the extract into the cup to mix with said sweetener-soda mixture;

at least one valve operatively disposed between each of said pumps and said dispensing head; and control means for regulating each of said pumps and each of said valves to effect the dispensing and control the foaming action in a cup such that a cold carbonated coffee beverage having a properly formed creme is formed.

7. A cold, carbonated coffee dispensing assembly as set forth in claim 6, wherein said dispensing head is configured such that the contents of said supply reservoirs mix external to said dispensing head.

8. A cold, carbonated coffee dispensing assembly according to claim 7, wherein said coffee extract is ejected directly from said dispensing head into said cup thereby at least partially creating foaming that at least partially forms the creme.

9. A cold, carbonated coffee dispensing assembly as set forth in claim 6, wherein each of said valves has means for adjusting the maximum flow rate through said valve.

10. A cold, carbonated coffee dispensing assembly as set forth in claim 6, further comprising a supply reservoir for holding decaffeinated coffee extract, and a supply reservoir for holding water.

11. A cold, carbonated coffee dispensing assembly as set forth in claim 10, wherein said supply reservoir for holding coffee extract is operatively connected to two of said pumps, and said supply reservoir for holding decaffeinated coffee extract is operatively connected to two of said pumps.

12. A cold, carbonated coffee dispensing assembly according to claim 6, wherein said control means regulates sequence and timing of dispensing from said supply reservoirs.

13. A cold, carbonated coffee dispensing assembly according to claim 12, wherein said control means is adapted to effect a provision of a splash of one of said coffee extracts onto said cold, carbonated coffee beverage at an end of the dispensing thereof.

14. A cold, carbonated coffee dispensing assembly according to claim 12, wherein said control means is adapted to effect a provision of a splash of said sweetener onto said cold, carbonated coffee beverage at an end of the dispensing thereof.

* * * * *